United States Patent [19]

Inoue

[11] 4,318,687

[45] Mar. 9, 1982

[54] GAS BURNER CONTROL SYSTEM

[75] Inventor: Kiyoshi Inoue, Tokyo, Japan

[73] Assignee: Inoue-Japax Research Incorporated, Yokohama, Japan

[21] Appl. No.: 974,083

[22] Filed: Dec. 28, 1978

[30] Foreign Application Priority Data

| | | | |
|---|---|---|---|
| Dec. 28, 1977 | [JP] | Japan | 52-159415 |
| Jan. 10, 1978 | [JP] | Japan | 53-1663 |
| Jan. 17, 1978 | [JP] | Japan | 53-3573 |
| Apr. 24, 1978 | [JP] | Japan | 53-48555 |
| Apr. 24, 1978 | [JP] | Japan | 53-48556 |
| Apr. 28, 1978 | [JP] | Japan | 53-52070 |

[51] Int. Cl.[3] ..... F23Q 9/08

[52] U.S. Cl. ..... 431/54; 431/59; 431/78

[58] Field of Search ..... 431/46, 53, 78–80, 431/54, 59; 361/159; 335/193; 337/100; 73/361

[56] References Cited

U.S. PATENT DOCUMENTS

| | | | |
|---|---|---|---|
| 1,742,367 | 1/1930 | Nettleton | 361/159 |
| 2,106,249 | 1/1938 | Hower | 431/59 |
| 2,170,878 | 8/1939 | Strecker | 361/159 |
| 2,366,774 | 1/1945 | Eskin | 431/59 |
| 3,091,285 | 5/1963 | Hassa | 431/54 |
| 3,179,885 | 4/1965 | Knudsen | 73/361 |
| 3,243,546 | 3/1966 | Woods | 335/193 |
| 3,393,038 | 7/1968 | Burkhalter | 431/75 |
| 3,474,372 | 10/1969 | Davenport | 337/100 |

FOREIGN PATENT DOCUMENTS

| | | |
|---|---|---|
| 814095 | 6/1959 | United Kingdom . |
| 1114604 | 5/1968 | United Kingdom . |
| 1223085 | 2/1971 | United Kingdom . |
| 1242687 | 8/1971 | United Kingdom . |
| 1303333 | 1/1973 | United Kingdom . |
| 1332153 | 10/1973 | United Kingdom . |

*Primary Examiner*—Joseph Man-Fu Moy
*Attorney, Agent, or Firm*—Karl F. Ross

[57] ABSTRACT

A burner system of the type in which a thermocouple or like EMF-generating sensor detects the presence of a pilot flame and controls a main fuel valve to hold the latter open as long as the pilot flame remains lit. According to the invention, the main valve is held open by a solenoid and a resistance is provided in circuit between the sensor and the solenoid to reduce the response time of the latter which results from the inductance contributed by the magnetic coil forming the solenoid.

29 Claims, 34 Drawing Figures

GAS BURNER CONTROL SYSTEM

FIELD OF THE INVENTION

The present invention relates to generally a gas burner control system and in particular a valve control system for gas burners of the type in which a thermocouple constituting a pilot flame sensor located in the proximity of a pilot burner is connected with a solenoid of an electromagnetic valve for feeding a fuel gas to a main burner to operate the electromagnetic valve in response to an electric signal developed at the thermocouple in the presence and absence of the pilot flame.

BACKGROUND OF THE INVENTION

In control systems of this genre, the thermocouple is responsive to heat of the pilot flame to generate an electromotive force which is applied to the solenoid to electromagnetically actuate the gas valve thereby allowing the fuel gas to be delivered to the main burner from a supply to automatically ignite the main flame. When the pilot flame goes out, the response of the thermocouple deactuates the electromagnetic valve to automatically shut off the fuel gas from the supply.

Such conventional gas burner control systems are inherently possessive of the disadvantage that due to an inductance of the solenoid associated with the electromagnetic valve, there is an objectionable delay after a pilot flame is ignited, and it is inconvenient to manually keep the valve knob on until the valve automatically actuates. After the extinction of the pilot flame there is also a delay in switching response until the valve automatically closes since the demagnetization of the electromagnet controlling the same is not effected promptly due to the solenoid inductance so that an objectionable leakage of the raw fuel gas may occur.

OBJECT OF THE INVENTION

It is accordingly the object of the present invention to provide a new and improved gas burner control system whereby the disadvantages of the conventional devices as described are overcome and the leakage of raw fuel gas is avoided.

SUMMARY OF THE INVENTION

In accordance with the present invention there is provided a control system for gas burners having a thermocouple responsive to the heat of a pilot flame to generate an electromotive force and an electromagnetic valve for communicating a main burner with a fuel gas supply with a solenoid connected with said thermocouple, the system comprising a resistor provided in a circuit connecting said thermocouple to said solenoid with a resistance sufficient to increase a time constant of said circuit to magnetize or demagnetize said electromagnet thereby increasing the response of said valve to the appearance and disappearance of said electromotive force.

BRIEF DESCRIPTION OF THE DRAWING

Certain embodiments of the invention will now be described hereinafter, which are given by way of example only, with reference to the accompanying drawing in which.

SPECIFIC DESCRIPTION

Figure 1:
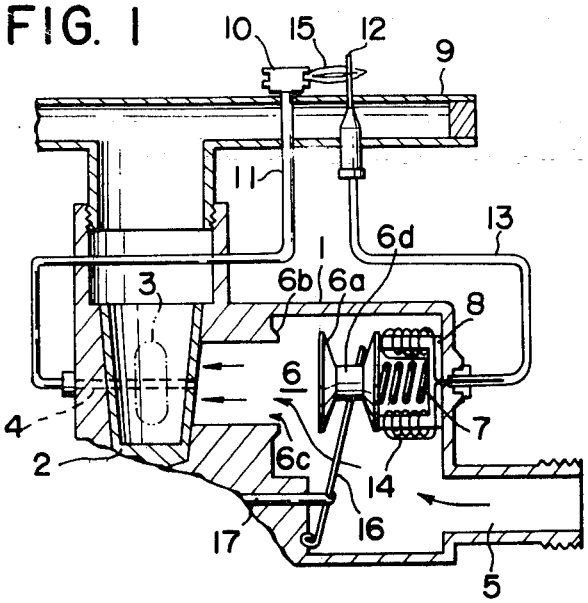
FIG. 1 is a sectional view in elevation diagrammatically illustrating a gas burner valve control system which may embody the principles of the present invention.

Referring now to FIG. 1 there is shown an essential portion of a gas burner including a valve casing 1 and a gas cock 2. The cock 2 is formed with a main gas flow opening 3 and a pilot gas flow opening 4 and is in the form of a plug slidably fitted with the body of the casing 1 for rotation to effect switching between the two openings to communicate with a fuel gas supply connected via a conduct 5. The fuel gas introduced via the conduit 5 flows through passages as indicated by arrows.

A valve body 6 comprises a disk 6*a* and a valve seat 6*b* defining a passage or orifice 6*c* for the fuel gas flow. The valve disk 6*a* has a stem 6*d* coupled with a spring 7 which normally urges the disk 6*a* against the seat 6*b* thereby closing the passage 6*c*. The stem 6*d* is also associated with an electromagnet 8 which when energized attracts the disk 6*a* against the spring 7 to open the passage 6*c* to allow the fuel gas to be fed in the region of the cock 2.

The latter communicates with a main burner 9 via the opening 3 and also with a pilot burner 10 from the opening 4 through a conduit 11.

Located in the proximity of the pilot burner 10 is a thermocouple 12 connected via leads 13 with a solenoid 14 of the electromagnet 8. The thermocouple 12, constituting a pilot flame sensor, is responsive to the heat of a pilot flame 15 to induce an electromagtive force which energizes the solenoid 14 of the electromagnet 8.

The valve stem 6*d* is also provided with one end of a lever 16 is secured at its other end of the body of the casing 1 with a pin 17 being projected through an aperture in the casing 1 and connected at a midpoint of the lever 16 to push upward the valve disk 6*a* in a position as shown. The pin 17 and the cock 2 may be adapted for operation either by a common or separate manipulators (not shown).

The lighting of the pilot flame 15 is effected with an igniter (not shown) of any known construction provided as a part of the system after turning the cock 2 to a position with the valve disk 6*a* pushed upward as shown by the pin 17 and lever 16 arrangement to open the passage 6*c* to allow the gas to be supplied to the pilot burner 10. The electromotive force generated at the thermocouple 12 in response to the pilot flame 15 causes the electromagnet 8 to be actuated to keep the valve disk 6*a* retracted to hold the pilot flame 15. Turning, in this state, of the cock 2 to a position which allows the passage 6*c* to be also in communication with the opening 3 (besides the opening 4) and hence with the main burner 9 will cause the latter to be ignited. When it is desired to extinguish the main burner 9, the cock 2 is turned to close the opening 4 to extinguish the pilot flame 15 and the electromagnet 8 will then be deactuated so that the spring 7 may urge the valve disk 6*a* against the seat 6*b* to close the passage 6*c* to the main burner 9.

If for any reason the pilot flame 15 goes out, safety of the system is automatically assured by the disappearance of the electromagnetic force at the thermocouple 12 which allows the electromagnet 8 to be deenergized to shut off the passage 6*c* from the fuel gas supply inlet 5. The The problem associated with earlier systems of this type is that it takes relatively long, 10 to 20 seconds at minimum until the gas supply is shut off by the electromagnet 8 responding to the extinction of the pilot flame 15. In this time interval, the opening 4 allows the fuel gas to be discharged via the conduit 11 to the deignited pilot burner 10. The leakage of the raw fuel gas is both dangerous and polluting.

In accordance with the present invention, this problem is overcome by accelerating the response of the electromagnetic valve to the pilot flame sensor constituted by the thermocouple. This is achieved by simply inserting a resistance in a circuit coupling the thermocouple with the solenoid of the electromagnet.

Figure 2:
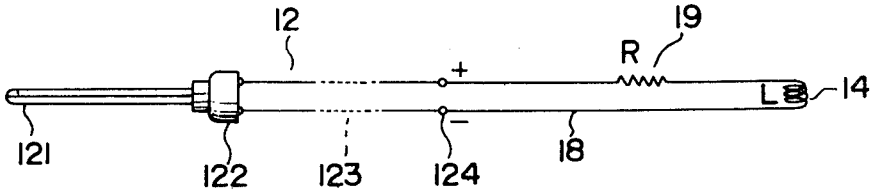
FIG. 2 is a diagrammatic view illustrating an electrical circuit coupling a pilot flame sensor with a solenoid of an electromagnetic valve according to the invention.

Referring to FIG. 2, the thermocouple 12 is shown comprising a flame-sensing portion 121 covered by a heat resistive material, a coupling 122, compensating or lead-out leads 123 and reference contacts or junctions 124 connected in series. From the reference contacts 124 there lie the leads 18 connecting to the solenoid 14 with a resistor 19 inserted in series therewith in accordance with the present invention.

With the solenoid 14 being, for example, 6000 $\mu$H and assuming that no resistance is existent except stray resistance which is of the order of 0.00128Ω in the series circuit with the solenoid 14, the time constant $\tau = L/R$ of the circuit would be 5 seconds and, with mechanical delay also taken into consideration, it will therefore take 10 seconds or more until the passage 6*c* is completely shut off with the electromagnet 8 responding to the thermocouple 12. In comparison, with the resistor 19 inserted which is of a resistance of 0.05Ω, the time constant is reduced to a fraction of a second so that the total time of response can be 2 or 3 seconds, permitting much quicker shut-off than required heretofore.

EXAMPLE I

Using a Cu-CuNi element thermocouple 12 and an enameled Cu wire of 1 mm diameter as a solenoid 14 in 8T×2 for an electromagnetic valve, the performance tests of the valve were conducted. With the resistor 19 being 0.0226Ω representing the total resistance in the circuit between the thermocouple 12 and the solenoid 14, the valve shut-off time was 2 seconds. When the resistance is 0.017Ω, the shut-off time was 3 seconds. With no resistor 19 inserted, the shut-off time was as long as 22 seconds.

The present invention therefore allows a quick switching of the valve between its opening and closing states, thereby eliminating the undesirable leakage of raw fuel gas.

The insertion of a resistor causes a drop, although slight, of the electromotive force or voltage which can be applied to the solenoid. Such drop can be effectively prevented through design considerations of the valve arrangement. For example, the spring 7 may be of a reduced spring force to allow the valve disk 6*a* to be displaced under a reduced magnetic attraction.

The resistor 19 inserted may be a variable resistor of negative temperature coefficient such as a thermistor and may be a material selected from the group consisting of SiC, $SnO_2$ and $Cr_2O_3$. The resistivity R of a thermistor is generally represented as a function of temperature T(°K.) by the expression: $R = R_oB(1/T - 1/T_o)$ where $R_o$ is an initial resistivity and B is a constant.

Figure 3:
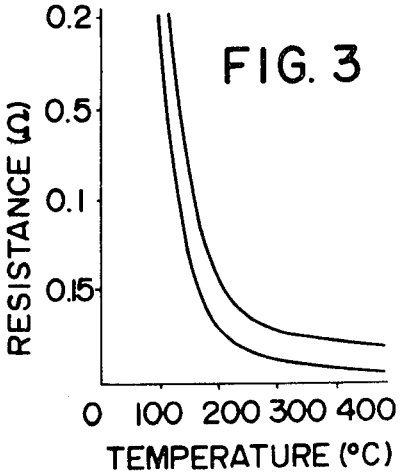
FIG. 3 is a graphical representation illustrating characteristic of thermistors which may form a resistive element incorporated in accordance with the invention.

FIG. 3 shows a resistivity-temperature curve for given thermistor materials which may constitute the resistor 19. The resistor in this case is placed in a heat receiving relationship with the pilot flame 15. Thus, in the presence of the pilot flame 15, the thermistor 19 has a reduced resistivity so that a loss of the thermoelectromotive force may be prevented. Upon disappearance of the pilot flame 15, the thermistor 19' will have a large resistivity, thus permitting an enhanced switching characteristic to be gained by the electromagnet 8 due to a reduced time constant L/R in the solenoid 14 circuit.

The resistor 19 may, of course, be provided in the compensating or lead-out conductors 123 besides or instead of load conductors 18.

Figure 4:
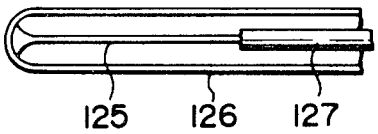
FIGS. 4 through 7 are diagrammatic views of modified forms of the electrical coupling according to the invention.
Figure 5:
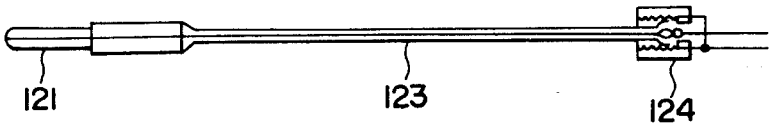
Figure 6:
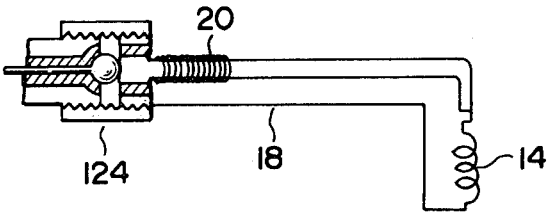
Figure 7:
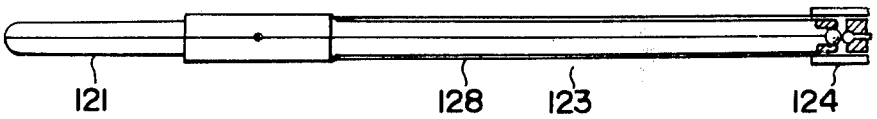

For inserting a proposed resistance in the electric circuit between the thermocouple 12 and the solenoid 14, the thickness, length or material of conductors may be chosen as appropriate to provide a predetermined resistance. FIG. 4 shows a thermocouple 12 designed to this end comprising a NiCu wire 125 of a reduced diameter and a Cu or Fe wire 126, the wire 125 being connected with a Cu wire 127 of a normal diameter. By controlling the wire diameter in this manner, a resistance of 0.02 to 0.05Ω as required is readily attained. FIG. 5 shows another form of thermocouple 12 in which the compensation or building-out conductors 123 connecting between the hot contact 121 and the reference contacts 124 and reduced in diameter and elongated to provide a required resistance. FIG. 6 shows a third embodiment of thermocouple 12 in which leads 18 connecting between the reference contacts 124 and the solenoid 14 are elongated and wound on a support 20. FIG. 7 shows a fourth embodiment 12 in which the compensating or building-out conductors 123 are composed of stainless steel to provide a necessary resistance in the circuit. The stainless wire may be coated with an oxide 128 to serve also as a heat resistor and insulator. The oxide can be readily obtained, for example, by heating an 18-8 stainless steel at a temperature of 450° C. The use of such an oxide also advantageously eliminates the need to coat a conductor with an insulating tube which has been required and is effective to make the conductor thinner as a whole.

Figure 8:
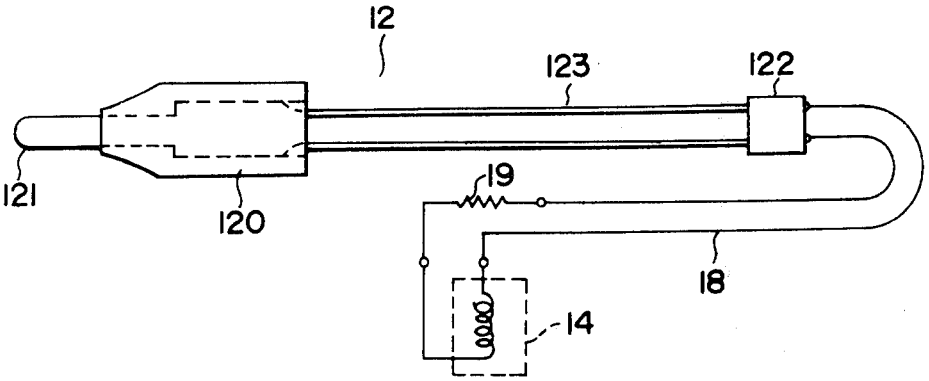
FIG. 8 diagrammatically illustrates a pilot flame sensor incorporating a covering designed to accelerate the response of the system in accordance with another aspect of the invention.
Figure 9:
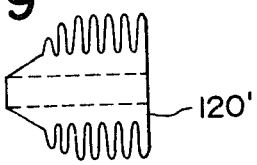
FIG. 9 represents a modified form of the flame sensor covering according to the invention.

In FIG. 8 there is shown a modified flame sensor 12 arrangement connected to the solenoid 14 in series with the resistor 19 in the coupling electrical circuit 18 as has been described. In this embodiment, the sensor 12 is provided with a covering 120 spaced at a distance, say, 5 to 10 mm, from the hot contact 121 and composed of a high heat-conductivity material such as copper or brass and the cold contacts 12Z are positioned spaced from the covering 20 with the compensating or building-out conductors 123. FIG. 9 shows a modified form of covering 120' having finned outer surfaces designed to gain an enhanced heat radiation effect. Although not shown, a suitable cooler (air or water) may be connected with the covering 120 or 120'.

By providing the flame sensor 12 with the covering 120, 120' having a large heat capacity at a location as described, a cooling effect on the hot contact point 121 is markedly increased at the instant of disappearance of the pilot flame 15 so that the thermoelectromotive force may drop rapidly.

EXAMPLE II

A heat-resistance thermocouple composed of 13 Cr has a temperature gradient 22° C./mm. A covering of a weight of 70 grams is disposed at a location of 10 mm from the hot contact. When the latter is placed heated at a temperature of 700° C. in contact with the pilot flame, the covering has a temperature of 250° C. and when the pilot flame is extinguished, the hot contact is rapidly reduced in temperature from 700° C. to 300° C., providing a rapid drop in effective thermoelectromotive force.

EXAMPLE III

Response tests for an electromagnetic valve are conducted with a thermocouple comprising Cu-CuNi connected via varying values of resistor in series with a solemoid comprising an enameled Cu wire of 1 mm diameter wound in 8T×2 on the electromagnetic valve. Tests are carried out also with and without a covering.

Figure 10:
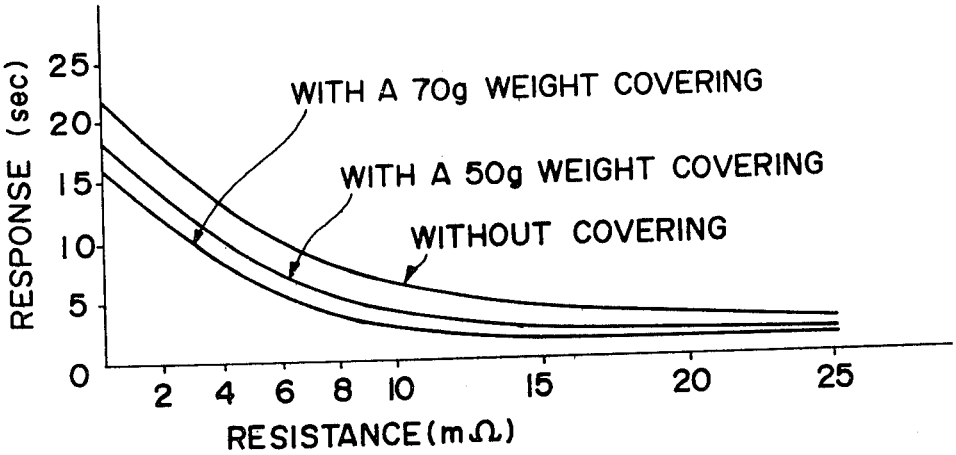
FIG. 10 illustrates response characteristics of the system with or without the flame sensor covering according to the invention.

FIG. 10 shows response characteristics of the valve in which the ordinate represents response time in second and the abscissa represents resistance of the resistor in MΩ, three curves representing results obtained without covering, with a covering of 50 grams and with that of 70 grams in weight, respectively.

It is seen that the valve which requires 22 seconds for shut-off in earlier systems accomplishes it in 2 to 3 seconds when provided with a resistance of 10 mΩ in its solenoid circuit and with a covering of 70 grams in weight at the flame sensor. A similar switching response is obtained with a covering of 50 grams and a circuit resistance of 12 mΩ.

Figure 11:
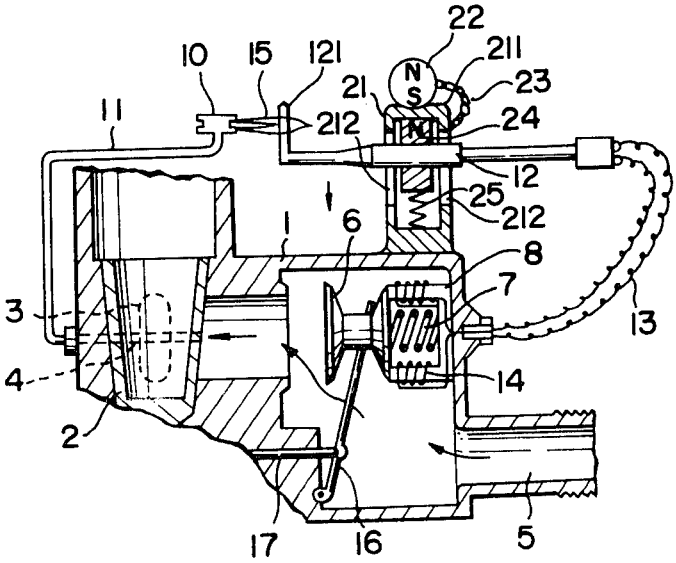
FIG. 11 diagrammatically illustrates a gas burner control system incorporating a vibration sensing switch in accordance with a further embodiment of the invention.

In FIG. 11 there is shown another embodiment of the invention which incorporates a vibration or trembling sensing unit associated with the electromagnetic valve system as has been described. The vibration sensing unit illustrated includes a stand 21 mounted on a portion of the valve casing 1 and having on its top a plate 211 receiving a spherical magnet 22. The magnet 22 is coupled to the stand 21 with a chain 23 to avoid loss upon dropping from the plate 211. The stand 21 has in its interior a magnetic plumb 24 supported on a spring 25 therein and also windows 212 through which the thermocouple assembly 12 extends. The assembly 12 as has been shown connects the sensing tip 121 placed for contact with the pilot flame 15 to the solenoid 14 of the electromagnetic valve 6 via the conductors 13.

In the spacing interior of the stand 21, the plumb 24 is normally held upward attracted by the spherical magnet 22, supporting the thermocouple assembly 12 with its sensing tip 121 positioned in contact with the pilot flame 15. The windows 212 of the stand 21 have widths to allow the assembly 12 axially extending therethrough to displace vertically and to permit it to drop resiliently supported by the spring 25 when the plumb 24 is demagnetized.

When in response to a trembling of the burner assembly caused, for instance, by an earthquake, the magnetic ball 22 tumbles down from the stand plate 211, the thermocouple assembly 12 held upward by the magnetic attraction of the magnet thereby will drop across the windows 212 by gravity. The spring 25 serves to protect the assembly 12 against damage. The sensing tip 121 of the thermocouple 12 is thus removed from the pilot flame 15 so that the electromotive force disappears thereby deenergizing the electromagnet 8 to shut off the passage **6*c* just as the pilot flame 15** is extinguished.

Figure 12:
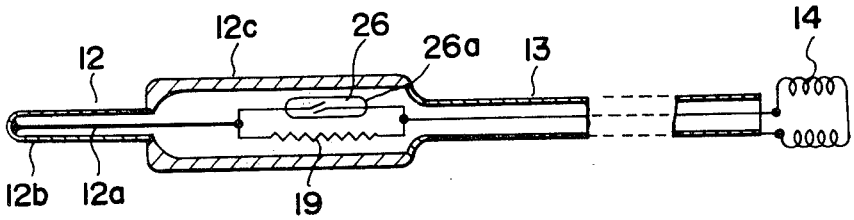
FIGS. 12 and 13 diagrammatically illustrate further forms of the flame sensor and electrical coupling arrangement embodying the invention.

FIG. 12 shows a further embodiments of thermocouple assembly 12 which, in addition to the resistor 19, incorporates a heat sensing switch 26 connected in parallel therewith to accelerate the switching response by the electromagnet 8 at the instant of the lighting of the pilot flame 15. The assembly 12 is shown comprising a metal wire **12*a* composed of AlNiMn, CrNi, Pt, PtRh or NiCu and a heat resistive metal cylinder 12*b* composed of 18-8 stainless steel, inconel or hastelloy arranged coaxial therewith forming a thermocouple hot contact point at their juction. The cylinder 12*b* has a support 12*c* attached therewith having an increased diameter connected via one of Cu leads 13 with the solenoid 14 of the electromagnet 8. The other lead 13 is connected to a coupling of the resistor 19 and the heat sensing switch 26 here constituted by a bimetal, with the parallel coupling being connected to the metal wire 21*a*. In order to protect the contacts thereof against oxidation, the bimetal 26 is shown hermetically sealed in a metal or glass casing 26*a* with its interior evacuated or filled with an inert gas. The bimetal 26** is adapted normally to close its contacts and, when heated to open the contacts.

In the absence of a pilot flame 15, the switch 26 is thus kept closed, shunting the resistor 19 from the circuit, which, as soon as a thermoelectromotive force develops at the thermocouple 12, allows it to be applied to the solenoid 14 to open the valve. The lighting of the pilot flame 15 causes the switch 26 to be open upon the heating temperature exceeding a predetermined value to place the resistor 19 in the circuit between the thermocouple 12 and the solenoid 14. Then, at the moment of extinction of the pilot flame 15, the circuit including the resistor 19 allows the electromagnet 8 instantaneously to deenergize to shut off the valve 6.

Figure 13:
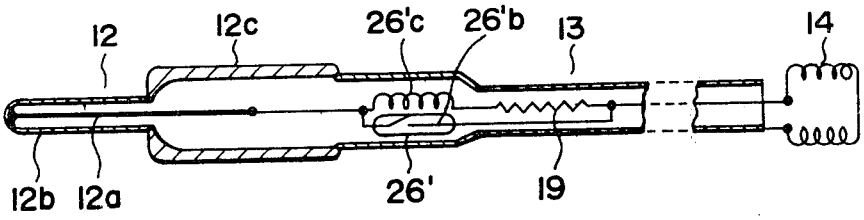

In a modified embodiment of FIG. 13, the resistance 19 is inserted in a circuit coupling the thermocouple assembly 12 to the solenoid 14. In this case, the resistance 19 may be provided by modifying the thickness, length and material of the lead 13 as adapted to achieve a required resistance value which may be 0.02 to 0.05 Ω as already noted.

Also, the switch 26 may be a heat sensitive magnetic switch 26' with one of contacts **26'*b* composed of ferrite, MnAl or MnCr which loses its magnetism at an elevated temperature of 200° to 250° C. in excess of its curie point. In this case, an energizing coil 26*c* is provided as shown to close contacts 26'*b* at a lower or room temperature. When heated by the pilot flame 15, the contacts 26*b* are opened rendering the resistor 19** effective in the circuit.

Figure 14:
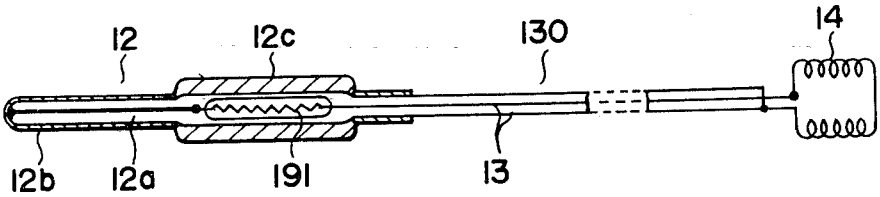
FIGS. 14 and 15 diagrammatically illustrate still further forms of the electrical coupling according to the invention.
Figure 15:
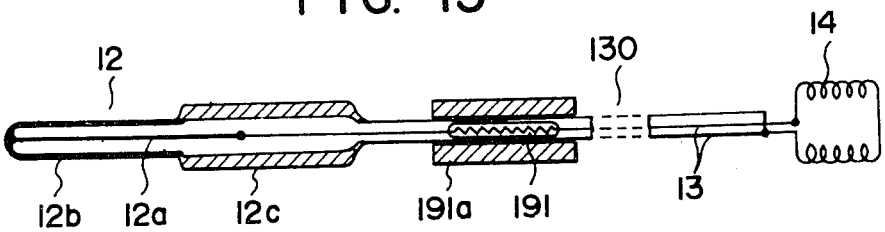

FIGS. 14 and 15 shows further embodiments of the invention in which the resistance inserted in the energizing circuit of the solenoid 14 is a positive temperature coefficient variable resistor 191. The resistor 191 may be inserted, as in the previous embodiments either in a portion of the thermocouple 12 (FIG. 14) or in a portion 130 coupling the thermocouple 12 to the solenoid 14 along the lead conductors 13 (FIG. 15). In both cases, a covering **12*c* (FIG. 14), 191*a* (FIG. 15) of a large heat capacity should be provided composed of copper, brass or the like high thermal-conductivity material to maintain the proximity of the resistor 191 at a low temperature, thereby maintaining the resistance of the resistor 191 at a reduced value before the pilot flame 15 is ignited so that at the moment of the ignition, the resistance in the circuit is negligible to allow an instantaneous actuation of the electromagnetic valve 6 without loss of the electromotive force developed. At the time of extinction of the pilot flame 15, with resistor 191 still at an increased temperature, the increased resistance will cause the deenergization of the electromagnet 8 to be effected instantaneously in response to the disappearance of the voltage at the thermocouple 12**.

Figure 16:
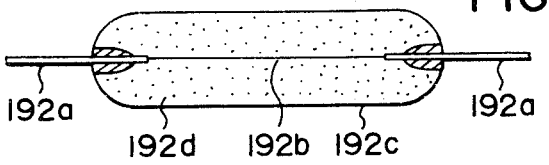
FIG. 16 is a schematic sectional view illustrating a resistive element which may be used in the embodiments of FIGS. 14 and 15.
Figure 17:
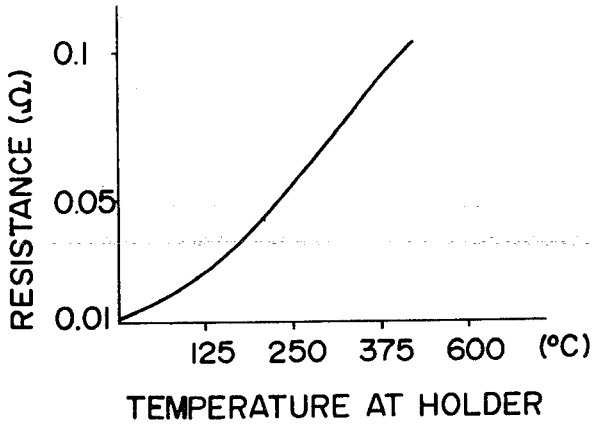
FIG. 17 is a graphical representation of the temperature-resistance characteristic of the said resistive element.

The positive temperature coefficient variable resistor 191 may be of the type illustrated in FIG. 16: In this embodiment, the unit 192 comprises a pair of copper lead wires **192*a* having a heat resistant wire resistor of positive temperature coefficient 192*b* bridged therebetween with the bridging portions of the wires 192*a* and 192*b* being hermetically sealed by a casing 192*c* composed of glass or stainless steel. The space within the casing 192*c* is filled with a nonoxidizing medium 192*d* which protects the wires 192*a* and 192*b* against oxidation and the casing 192*c* is used in contact or heat-conducting relationship with the large heat-capacity covering 12*c* 191*a* shown in FIGS. 14 and 15**.

The wire resistor **192*b* is adjusted in length, thickness and composition to have a resistance between 0.01 and 0.05 Ω as noted earlier at a room temperature. FIG. 16 shows temperature-resistance characteristic of a 13 Cr wire of 0.12 mm diameter hermetically sealed within a stainless-steel casing filled with a glass powder of 3 mm thickness when the unit so formed is disposed in a high heat capacity holder zone 12*c* of FIG. 14. The unit which shows a resistance of 0.012 Ω at a room temperature has the resistance increased to 0.1 Ω at 400° C. The holder zone 12*c*** has a temperature of 210° C. at the moment of extinction of a pilot flame.

EXAMPLE IV

Figure 18:
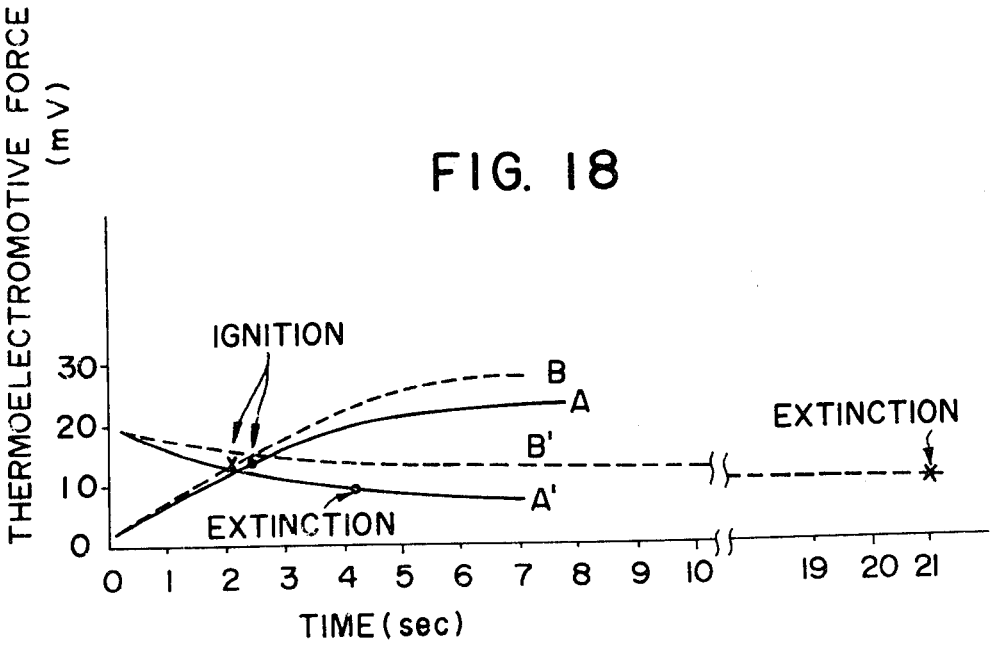
FIG. 18 is a graphical representation illustrating valve performance characteristics with and without the features of the invention.

The variable resistor unit just described is used with an electromagnetic valve control system using a copper-constantan thermocouple. In FIG. 18, the resulting valve response characteristic is represented as curves A in comparison with those with the prior art represented as curves B, the two curves for each of A and B representing characteristics at the moment of flame ignition and extinction, respectively. It has been observed that while there is no substantial difference in response between the prior art and the present system with 2 seconds for response in both after the flame ignition, the present system responds in about 4 seconds, much faster than about 21 seconds in the prior system, after the flame extinction.

EXAMPLE V

In the embodiment of FIG. 16, the wire **192*b* is composed of iron and hermatically sealed within a glass tube 192*c* filled with hydrogen gas as the nonoxidizing medium 192*d*. With this unit utilized as a variable resistor, the valve 6** is found to respond in 1 to 1.6 seconds after the flame ignition and in 3 to 3.5 seconds after the flame extinction.

Figure 19:
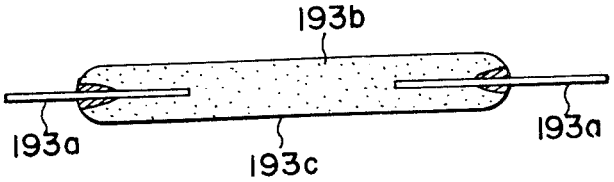
FIGS. 19 and 20 are schematic sectional view of further resistive elements according to the invention.
Figure 21:
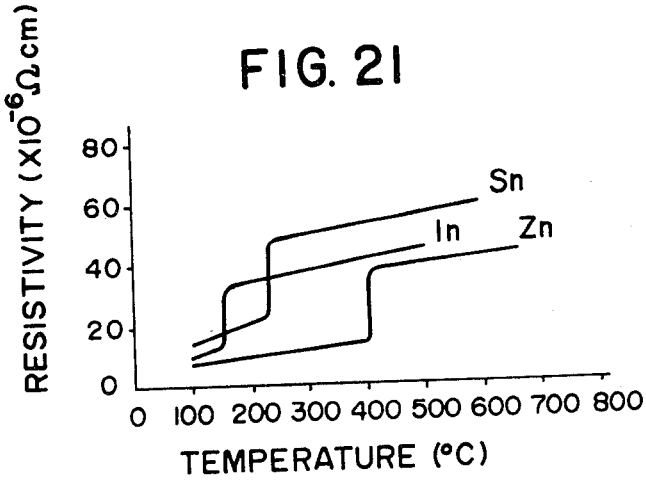
FIG. 21 is a graphical representation of characteristic of certain materials utilized in the embodiment of FIG. 19.

In an embodiment of FIG. 19, a pair of lead wires **193*a* are spacedly juxtaposed and hermetically sealed in a glass casing 193*c* filled with a metal 193*b* of a low melting point which may be In, Sn, Zn, Bi, Cd, Ga, K, Li, Na, Pb, Mg, Rb, Tl, Al, Sb, Co or any of alloys thereof. The casing 193*c* may alternatively be a stainless steel when an appropriate insulation is provided with the lead wires 193*d*. A metal or alloy as listed composing the filling 193*b* is a solid state in a room temperature and has a property to sharply increase its resistance as the temperature exceeds the melting point. Three curves shown in FIG. 21 represent temperature-resistance characteristics of Sn, In and Zn, respectively, from which it is seen that each metal changes its resistance sharply when the melting point is traversed. It is thus noted that by using a unit 193** as well comprising such a low-melting point metal hermetically sealed, a marked enhancement of valve response herein concerned is readily achieved. The hermetical sealing of such a metal or alloy permits a repeated use at stability for response after recurrent melting and solidification.

EXAMPLE VI

In a glass tube of 3.8 mm in diameter and 20 mm long, 0.26 gram of Sn is sealed with a pair of Cu lead wires projected therefrom to form a variable resistor unit, which is disposed in contact with a wall of a holder therefor adapted to possess a high heat capacity and inserted in a valve control circuit as shown in FIG. 14. When the thermocouple is heated at 300° C. in contact with a pilot flame, an electric current of 0.4 to 0.6 ampere is passed to open the valve. When the thermocouple is heated to 500° C., Sn has a temperature in excess of 232° C. to start to be melted, increasing its resistance suddenly. The current of 0.4 to 0.6 ampere then continues to flow with the valve kept open. The pilot flame is then extinguished to allow the thermocouple to spontaneously cool and the valve is found to be shut off in 2 to 3 seconds after the extinguishment of the pilot flame. This response of the valve is compared with 22 seconds needed with the conventional control system. The use of In in 0.25 gram instead of Sn shows a response of 3 to 4 seconds for valve shut-off.

Figure 20:
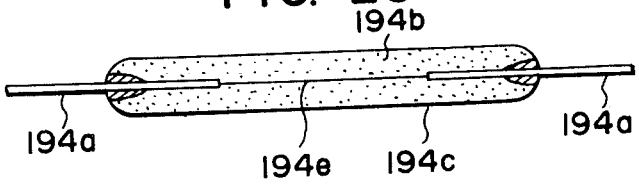

In a modified embodiment shown in FIG. 20, a pair of lead wires 194*a* are bridged in a glass tube 194*c* by a thin metal wire 194*e* in a diameter of 0.1 to 0.5 mm, which may be composed of Fe or Ni, in the filling of a low melting point metal 194*b*. The thin metal wire 194*e* may be coated by plating or evaporation with the same metal as the filling 194*b*. This facilitates adjustment of the initial resistance (at low temperature) which may be fixed at 0.01 to 0.15 Ω by adjusting the thickness, length and composition of the wire 194*e* and the composition of the filling 194*b* as appropriate.

Figure 22:
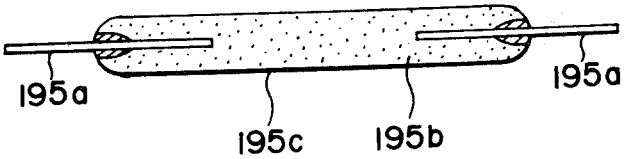
FIG. 22 schematically illustrates another embodiment of the resistor and FIG. 23 is a graphical representation of characteristic thereof.

In a variation of FIG. 22, a filling 195*b* sealed within a glass tube 195*c* with a pair of lead wire 195*a* projected therefrom is composed of a semiconductor resistor material having a positive temperature coefficient which may be a sintered mass of ZnO (n-type semiconductor) powder in mixture with Bi, Sb, Co, Mn and/or Cr. The powder metal oxide may alternatively be $Bi_2O_3$, MnO, $Sb_2O_3$, coO or $Cr_2O_3$. Also, $ZnO_2$, $Nd_2O_3$, $ZrO_2$ and $Pr_6O_{11}$ singly or in combination may be used. A composition $[ZnO_2, Nd_2O_3 + ZrO_2]$ varies its resistivity from 10 to 100 Ω cm with 400° C. max, a composition $Nd_2O_3$ from 10 to 100 Ω cm with 200° C. max. and a composition $[Nd_2O_3 + Pr_6O_{11}]$ from 10 to 100 Ω cm with 300° C. max.

EXAMPLE VII

Figure 23:
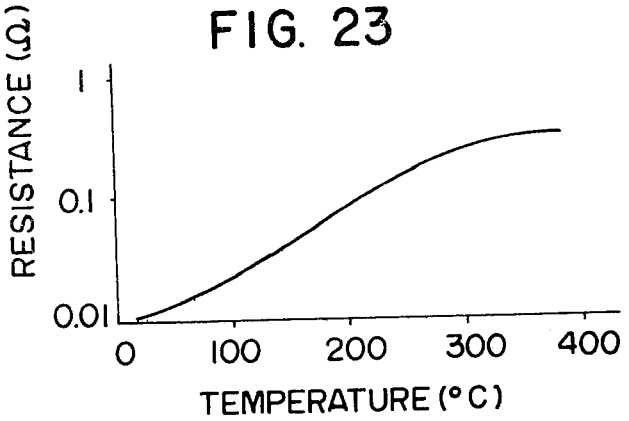

A variable resistor is prepared by sintering a $ZnO_2$ powder in $N_2$ atmosphere and mechanically pulverizing the sintered mass to form a powder of ZnO which is bonded together with a frit at 500° C. A heat sensitive characteristic of this resistor is shown in FIG. 23 in which the ordinate represents resistance and the abscissa represents temperature at a holder portion (12*c* in FIG. 14), indicating the resistance of 0.01 Ω at a room temperature and 1.5 Ω at 250° C. The use of this resistor in the valve circuit is found to permit the valve to open in 3 to 5 seconds after the lighting of the pilot flame and to close in 2 to 5 seconds after the pilot flame dies out.

Figure 24:
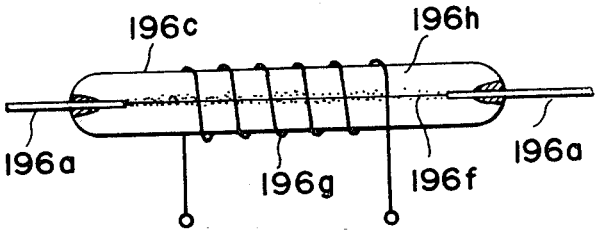
FIG. 24 shows another modified electrical coupling according to the invention.

The variable resistor which may be used in accordance with the invention may also be of a form shown in FIG. 24. In this embodiment, a thin wire 196*f* of magnetic material is bridged across a pair of lead wires 196*a* in a glass tube 196*c* having a coil 196*g* wound thereon and a powdery magnetic material 196*h* sealed therein. When the coil 196*g* is energized, the powder 196*h* is magnetically attracted to the wire 196*f* to reduce the resistance between the leads 196*a*. However, the increase of temperature exceeding the curie point of either powder 196*h* or wire 196*f* causes the powder to dislodge from the wire, thereby increasing the resistance between the leads 196*a*.

Figure 25:
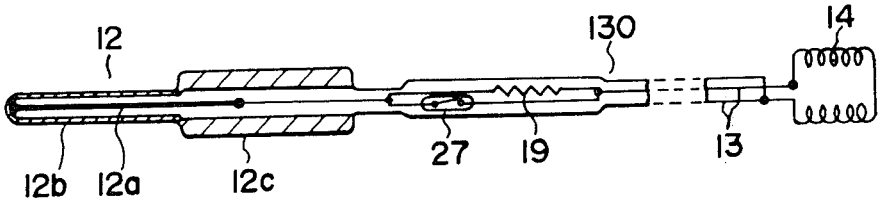
FIG. 25 shows another modified electrical coupling according to the invention.

FIG. 25 shows a further embodiment of the present invention which incorporates a switch 27 in parallel with the resistor 19 in the electrical circuit 130 connecting the thermocouple 12 to the valve solenoid 14 via lead lines 13, and a control circuit for operating the switch 27. The switch 27 may be any of various forms including a mechanical contact switch, lead relay and an electronic switch. Where a contact switch is used, contacts are hermetically sealed hermetically in a non-oxidizing gas filled tube to protect them against oxidation. In general, the switch 27 is adapted to turn on (closed) when the pilot flame lights thereby opening the valve and to turn off (open) when it goes out. When the switch 27 is turned off or open, the resistor 19 is rendered effective in the circuit 130 between the thermocouple 12 and the solenoid 14 so that the latter may be energized at an accelerated resoonse with the voltage generated at the thermocouple 12.

Figure 26:
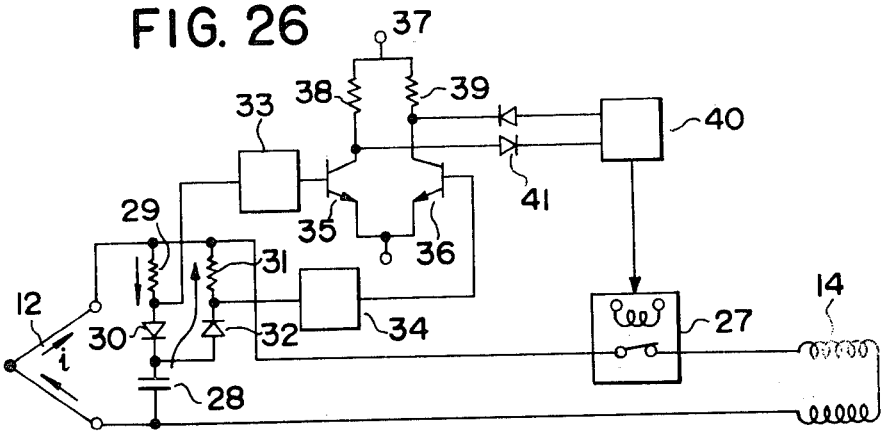
FIG. 26 is a circuit diagram of a signal detecting and control unit still further embodying the invention.

A control circuit for operating the switch 27 is shown in FIG. 26 in which the thermocouple is generally denoted at 12 which provides a switching signal for the switch 27 as well as an energizing voltage for the solenoid 14 which is connected in series with the thermocouple 12 via the switch 27. This system includes a capacitor 28 which is connected to the thermocouple 12 in series with a pair of series connected resister-diode couplings 29, 30; 31, 32 connected parallel with each other with the diodes being arranged to allow current flow in opposite directions. A pair of signal sensing units 33 and 34 are fed from the junction of resistor 29 and diode 30 and the junction of resistor 31 and diode 32, respectively, to apply the corresponding signals to the base-emitter circuits of transistors 35 and 36, respectively. The collector-emitter circuits of the transistors 35 and 36 are fed with a common power supply 37 via resistors 38 and 39, respectively and voltage drops which develop at the resistors 38 and 39 are applied to a switch control network 40 for the switch 27 via a rectifier 41.

Figure 27:
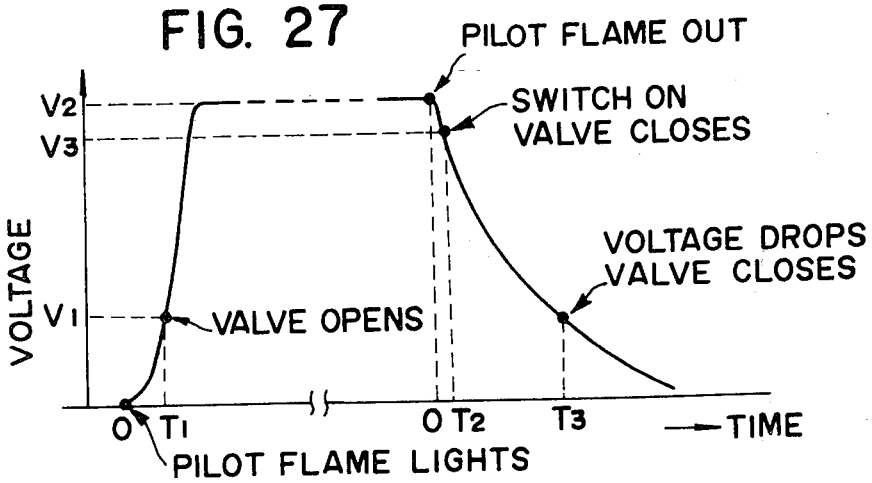
FIG. 27 schematically illustrates characteristic in change of the thermoelectromotive force generated in a thermocouple.

The description of the mode of operation of the circuit of FIG. 26 may be had with reference to a graphical diagram shown in FIG. 27 in which the ordinate represents thermoelectromotive force developing at the thermocouple 12 or voltage at the capacitor 28 and the abscissa represents time. When the pilot flame is ignited to heat the thermocouple 12, a current i is thermoelectrically induced flowing in the direction of arrow to charge the capacitor 28. The voltage drop produced at the resistor 29 by the charging current is input to the signal circuit 33. When the input signal exceeds a preset value $V_1$, the circuit 33 provides a switching signal to the transistor 35 to render it conductive so that a voltage drop develops at the resistor 38 and is fed to the switching network 40. The latter now provides a control signal to the switch 25 to turn it on thereby permitting the solenoid 14 to be energized by the voltage at the thermocouple 12 to open the valve (at $T_1$). The terminal voltage of the capacitor 28 continues to rise until it is saturated at $V_2$. Thereafter, if for any reason the pilot flame dies out, the terminal voltage at the capacitor 28 will decay in response to diminusion of the thermoelectric voltage at the thermocouple 12 and the charge will then flow back to the thermocouple through the resistor 31. When the voltage drop then traverses a preset value $V_3$, the detector 34 causes the transistor 36 to turn on. The voltage then develops at the resistor and is responded by the network 40 which turns the switch 27 off to close the valve (at $T_2$). The timing of the closure of the valve is 2 or 3 seconds after the extinction of the pilot flame and thus greatly prompted, compared with about 20 seconds ($T_3$) which is the case with the conventional system.

Figure 28:
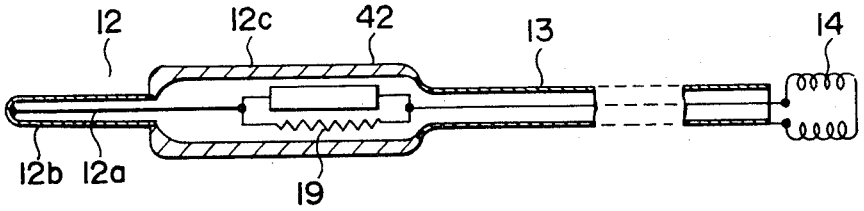
Figure 29:
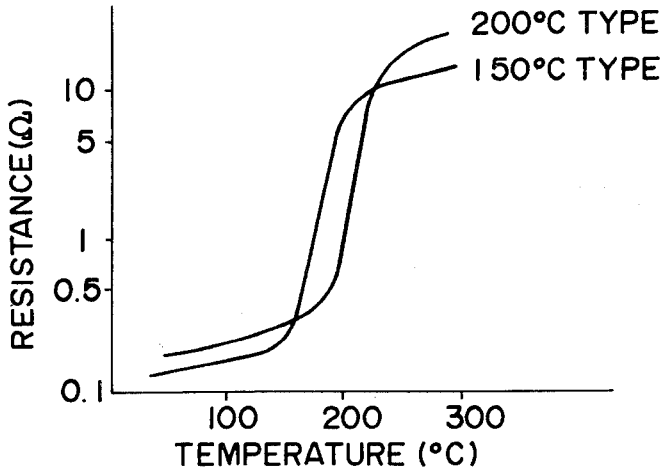
Figure 30:
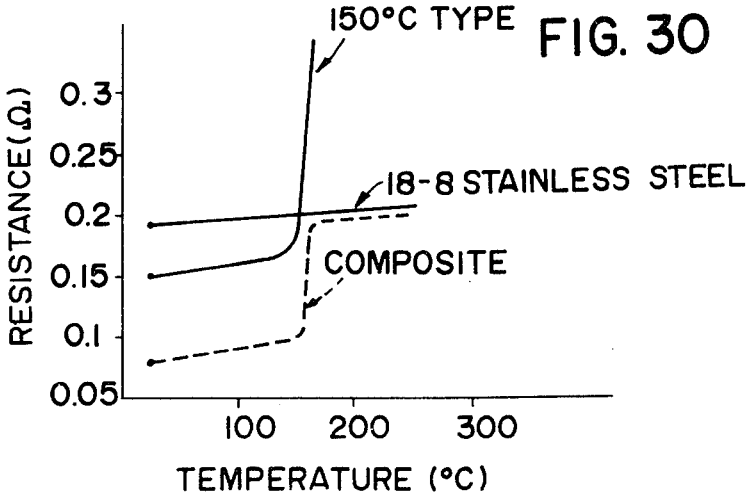

FIG. 28 shows a further embodiment of the present invention in which a variable resistor 42 which is of low resistance at a room temperature but increases the resistance sharply at an elevated temperature is provided in parallel with the response accelerating resistor 19 in the compensating or building-out conductors of the thermocouple 12. Such variable resistor may be composed of any of the semiconductor materials including barium titanate, zinc oxide, bismuth oxide, manganese oxide, antimony oxide, cobalt oxide, neodium oxide, circonium oxide and praseodymium oxide singly or in combination. The temperature-resistance characteristic of bodies of barium titanate each in 10 mm diameter is shown in FIG. 29 with regard to those of 150° C. and 200° C. types thereof, which undergo a sharp resistance change at 150° C. and 200° C. respectively from a value of 0.1 to 0.2 Ω at a room temperature. The fixed resistor 19 may be composed of 18-8 stainless steel which has a resistance of 0.2 Ω at 150° C. Thus, with this stainless steel and the 150° C. type barium titanate used in parallel as the resisters 19 and 42 in FIG. 28, an excellent variable resistance characteristic is obtained as is apparent from FIG. 30. It is seen that the composite resistance which is less than 0.1 Ω at a room temperature is suddenly increased to approximating 0.2 Ω when the temperature of 150° C. is exceeded.

Figure 31:
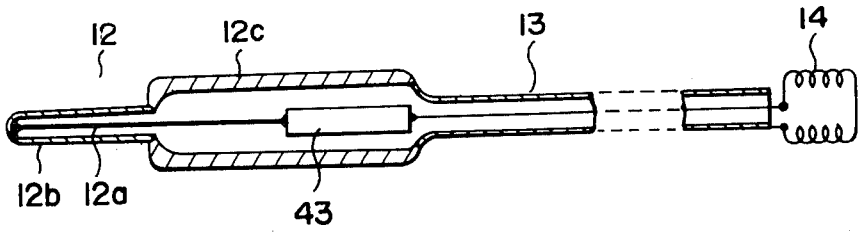
Figure 32:
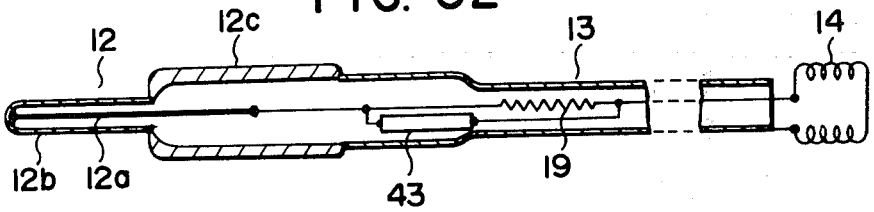

In further variations embodying the present invention shown in FIGS. 31 and 32, the resistor inserted in the energizing circuit for the solenoid 14 is a variable resistor 42 having the property to change its resistance as a function of the current passing therethrough. In FIG. 31, such resistor 42 is connected in the compensation or building-out conductors of the thermocouple 12. The resistor 42 should be any of materials exhibiting such property and may be a semiconductor such as $BaTiO_3$ and this aspect of the invention employs the non-linearty of resistance change of such material with respect to the current applied therethrough. If the main component of the resistor 42 is $BaTiO_3$, it is recommended to incorporate $La_2O_3$, $Sb_2O_5$, $Y^{3+}$, $La^{3+}$, $Ce^{3+}$, $Pr^{3+}$, $Nd^{3+}$, $Sn^{3+}$, $Gd^{3+}$, $Er^{3+}$, $Sb^{3+}$, $Bi^{3+}$, $Nb^{5+}$, $Ta^{5+}$ and/or $W^{6+}$ which facilitate the formation of irregular particle aggregations. The additive may also be one or more substances belonging to (Ba, Sr)$TiO_3$ family, (Ba, Mg)$TiO_3$ family, Ba(Zr)$O_3$ family and Ba(TiSi)$O_3$ family capable of changing the curie point. These composition have resistivity of 1 to 10 Ω cm which are capable of increase in the range of $10^4$ to $10^5$ Ω cm with current applied.

Figure 33:
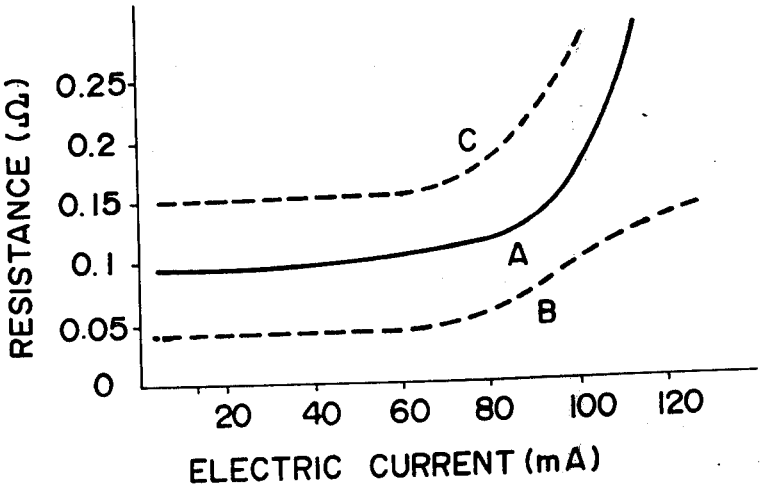

Typical resistivity-current characteristic of a body of $BaTiO_3$ 10 mm in diameter is shown in FIG. 33 at the curve A. It is seen that the resistance which is 0.1 Ω with a current less than 100 mA increases suddenly when the current of 100 mA is exceeded. In the graph of FIG. 33, dotted curve labelled as B represents characteristic resulting from the use of the same variable resistor connected in parallel with a fixed resistance (FIG. 32) and the dotted curve C represents characteristic of the series connection of the variable resistance with a fixed resistor.

Figure 34:
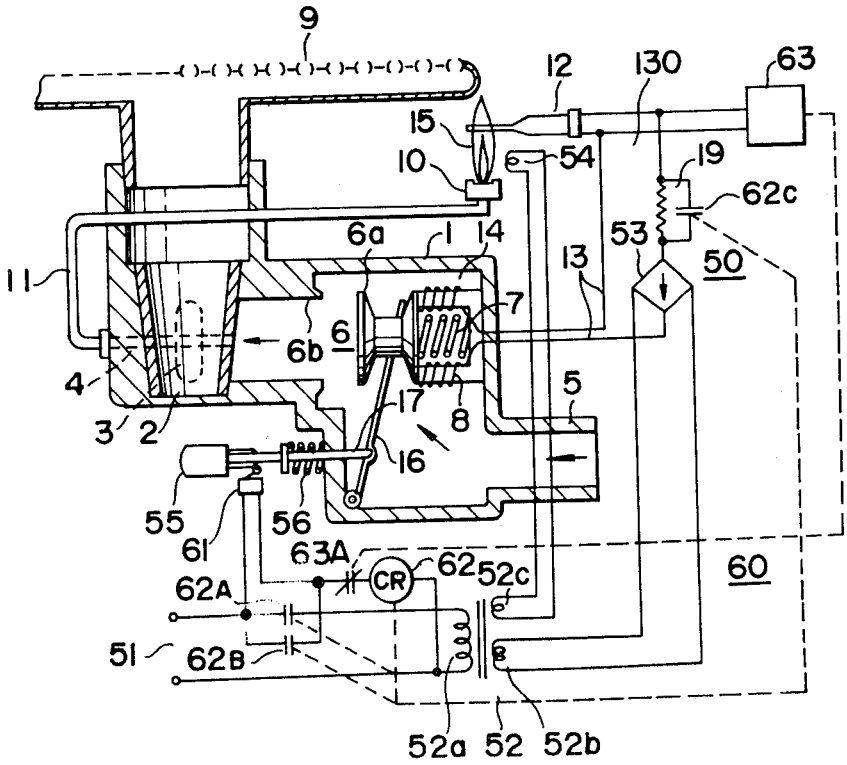
FIGS. 28 through 34 illustrate further modifications and variations of the invention.

FIG. 34 shows still another form of the present invention with the same reference numerals used designating the same or similar parts or components described already. In this embodiment, an auxiliary power supply 50 is provided in the circuit 130 connecting the thermocouple 12 to the solenoid 14 for the electromagnetic valve 6, and an operating network 60 for the auxiliary power supply 50.

The power supply 50 includes an AC source 51 whose input terminals are connected to the primary winding **52*a* of a stepdown transformer whose secondary winding 52*b* feeds into the input of a rectifier 53. The output terminals of the rectifier 53 are shown lying in the solenoid energizing circuit 130 in series with the resistor 19 and designed to provide an auxiliary voltage of the same polarity as that delivered by the thermocouple 12 to the solenoid 14. The transformer 52 has an additional secondary winding 52*c* which feeds an ignition coil 54 located in the proximity of the pilot burner 10 to light the pilot flame 15**.

The pin 17 connected to the lever 16 for manually opening the valve 6 is here shown connected with a push button knob 55 via a spring 56 which serves to normally close the valve 6 so that when the knob 55 is depressed or freed, the spring 56 acts to pull the pin 17 to close the valve 6.

Shown coupled with the knob or button 55 is a limit switch 61 adapted to turn on and off when the button 55 is pressed and depressed, respectively. The limit switch 61 has lead conductors connected across the input terminals of the AC source 51 via a relay 52. The limit switch 61 and the relay 62 constitute parts of the control circuit 60 including a detector/discriminator circuit 63 connected to the thermocouple 12 in parallel with the solenoid energizing circuit 130. Normally open contacts 62A and 62B and normally closed contacts 63A lie in the primary portion of the transformer 52 and the lead switch 61 circuit. The additional contacts **62*c* of the relay 62 which is of self-holding type are connected in parallel with the resistor 19 and in series with the rectifier 53**.

When the button 55 is pressed, the valve 6 is opened, permitting a fuel gas from the inlet conduit 5 to be fed to the pilot burner 10. Simultaneously, the limit switch 61 is turned on. This causes the normally open contacts 62A to be closed, permitting the AC output 51 to be applied across the primary winding **52*a* of the transformer 52 so that the ignition coil 54 is energized to light the pilot flame 15 at the pilot burner while the auxiliary voltage develops at the output terminals of the rectifier 53. Since the contacts 62*c* are at the same time closed, the resistor 19 in parallel therewith becomes ineffective and the auxiliary voltage is directly applied across the solenoid 14 to instantaneously actuate the electromagnet 8 and consequently to hold the valve 6 open. Then, by manually turning the cock 3 to open the conduit 3 to allow the fuel gas to be supplied to the main burner 9, the main flame is lighted with the pilot flame 15**.

The function of the detector/discriminator circuit 63 is to detect the thermoelectromotive force which develops at the thermocouple 12 in response to heating by the pilot flame 15 and, when it reaches a predetermined valve, to provide a switching signal. This signal is applied to open the contacts 63A thereby deenergizing the relay 62. The deenergization of the relay 62 opens the contacts 62A so that the primary **52*a* of the transformer 52 is disconnected from the AC source 51. Thus, the auxiliary voltage disappers in the solenoid circuit 130. At this time, the thermoelectromotive force has fully developed at the thermocouple 12 to keep the electromagnet 8 sufficiently actuated to hold the valve 6 open. And the contacts 62*c* are now open to render the resistor 19 effective in the circuit 130**.

If for any reason the pilot flame 15 dies out the energizing voltage at the thermocouple 12 decays and the circuit 130 provided with the resistor 19 deenergizes the electromagnet at an increased response as described in conjunction with the previous embodiments of the invention to assure a prompted closure and shut-off of the fuel valve 6. With the inductance of the solenoid 14 being 6000 $\mu$H and the resistance of the resistor 19 being 0.2 $\Omega$, the time constant $\tau = L/R$ becomes 0.03 seconds which means that the valve is shut off within 2 to 3 seconds after the pilot flame dies out.

For the inductance value for a practical electromagnetic valve solenoid which is in the order of thousands $\mu$H or thousandth H, the resistance included in series therewith in accordance with the invention should in general be at least 0.005 $\Omega$ and preferably not less than 0.01$\Omega$, thus at least one order greater than the free resistance value inherently present in the circuit coupling the thermocouple to the solenoid. As has also been shown, if a proper measure is taken for response at the time of ignition of a pilot flame, the lower limit of the resistance may be increased to 0.1$\Omega$.

There is thus provided in accordance with the present invention an improve burner value control system which assures an accelerated valve switching response and whereby the undesirable leakage of the fuel gas is eliminated.

What is claimed is:

1. In a valve control system having a thermocouple located, in use of the system, in the proximity of a pilot flame for gas burner for producing a thermoelectromotive force in response to said pilot flame, an electromagnetic valve controllable for opening and closing a gas supply duct for supplying gas to said burner, a solenoid associated with said electromagnetic valve and connectable in circuit with said thermocouple for energization by said thermoelectromotive force whereby to actuate said electromagnetic valve, the improvement which comprises a resistance and connecting means for connecting said thermocouple, said solenoid and said resistance in series to form a closed series circuit.

2. The improvement defined in claim 1 wherein said resistance is at least 0.005$\Omega$.

3. The improvement defined in claim 2 wherein said resistance is at least 0.01$\Omega$.

4. The improvement defined in claim 3 wherein said resistance is at least 0.1$\Omega$.

5. The improvement defined in claim 2 wherein said resistance is of a value at least one order of magnitude greater than the free resistance in said circuit.

6. The improvement defined in claim 1 wherein at least one of the thickness, length and composition of at least a portion of conductors constituting said circuit is adapted to provide a desired value of said resistance.

7. The improvement defined in claim 1, further comprising a covering of a large heat capacity associated with said thermocouple and located a distance from a sensing junction of said thermocouple.

8. The improvement defined in claim 7 wherein said distance is 5 to 10 mm.

9. The improvement defined in claim 7 wherein said covering is composed of a material selected from the group consisting of copper and brass.

10. The improvement defined in claim 1 wherein said covering is formed with a fin.

11. The improvement defined claim 1, further comprising a vibration sensor responsive to a trembling of a support carrying said burner for shutting off said valve.

12. The improvement defined in claim 11 wherein said vibration sensor comprises means responsive to said trembling for removing said thermocouple from said pilot flame.

13. The improvement defined in claim 1, further comprising a heat sensitive switch connected in parallel with said resistance.

14. The improvement defined in claim 13 wherein a covering of a large heat capacity is provided in heat transmitting relationship with said switch.

15. The improvement defined in claim 14 wherein said switch is a bimetal switch.

16. The improvement defined in claim 14 wherein said switch is a magnetic switch.

17. The improvement defined in claim 1 wherein said resistance is a resistor having a negative temperature coefficient.

18. The improvement defined in claim 17 wherein said resistor is composed of a material selected from the group consisting of SiC, $SnO_2$ and $Cr_2O_3$.

19. The improvement defined in claim 1 wherein said resistance is a resistor having a positive temperature coefficient.

20. The improvement defined in claim 19 wherein a covering of a large heat capacity is provided in heat conducting relationship with said resistor.

21. The improvement defined in claim 19 wherein said resistor is bridged between a pair of lead wires within a casing filled with a non-oxidizing medium.

22. The improvement defined in claim 19 wherein said resistor comprises at least one of low melting point materials substance selected from the group consisting of In, Sn, Zn, Bi, Cd, Ga, K, Li; Na, Pb, Mg, Rb, Tl, Al, Sb and Ca, hermetically sealed in a casing of heat resistant material and a pair of lead wires introduced therein.

23. The improvement defined in claim 19 wherein said resistor comprises a semiconductor material bridging a pair of lead wires within a hermetically sealed casing.

24. The improvement defined in claim 1, further comprising a switch connected in said circuit operable in response to the thermoelectromotive force generated at said thermocouple.

25. The improvement defined in claim 1, further comprising a heat sensitive resistor connected in parallel with said resistance.

26. The improvement defined in claim 25 wherein said resistor is composed at least in part of barium titanate.

27. The improvement defined in claim 1 wherein said resistor comprises a resistor having a property to change its resistence as a function of an electric current passing therethrough.

28. The improvement defined in claim 1, further comprising an auxiliary voltage supply selectively rendered effective in series with said thermocouple and said solenoid in response to the ignition of said pilot flame.

29. In a valve control system for a gas burner having a thermocouple located in the proximity of a pilot flame for producing a thermoelectromotive force in response to said pilot flame, a valve controllable for opening and closing gas supply to said burner, a solenoid having an armature mechanically connected to said valve and a coil for electromagnetically displacing said armature connected in circuit with said thermocouple by conductive leads for energization by said thermoelectromotive force to actuate said valve, the improvement which comprises a lumped resistance having an ohmic value greater than that of the circuit consisting of said coil, said thermocouple and said leads said lumped resistance being connected in series between said thermocouple and said coil.

* * * * *